United States Patent [19]

Hall

[11] 4,386,778

[45] Jun. 7, 1983

[54] CONSTRUCTION INDUSTRY TEACHING GAME

[76] Inventor: William C. Hall, 29 Briardale Ct., Derwood, Md. 20855

[21] Appl. No.: 347,667

[22] Filed: Feb. 10, 1982

[51] Int. Cl.[3] ..... A63F 3/00

[52] U.S. Cl. ..... 273/256; 434/107

[58] Field of Search ..... 273/256, 243, 278, 240; 434/107

[56] References Cited

U.S. PATENT DOCUMENTS

| | | | |
|---|---|---|---|
| 3,058,747 | 10/1962 | Nemetsky | 273/256 |
| 3,539,189 | 11/1970 | Shelton | 273/256 |
| 3,726,527 | 4/1973 | Schauffler | 273/256 |
| 4,179,128 | 12/1979 | Zelazny | 273/256 X |

FOREIGN PATENT DOCUMENTS

| | | | |
|---|---|---|---|
| 2424177 | 12/1975 | Fed. Rep. of Germany | 273/278 |
| 2302119 | 9/1976 | France | 273/278 |
| 2425873 | 12/1979 | France | 273/256 |
| 2456534 | 12/1980 | France | 273/278 |

*Primary Examiner*—Richard C. Pinkham
*Assistant Examiner*—Scott L. Brown
*Attorney, Agent, or Firm*—John E. Benoit

[57] ABSTRACT

A construction industry teaching game for developing skills in building, finance, accounting, OSHA regulations, specialty construction and the like. A game board having a track divided into areas which direct specified actions to be taken is used with dice and game pieces and a plurality of decks of cards relating to the particular job, labor factors, research and penalties. Forms are provided for bid submittals, annual accounting and determination of fixed costs.

4 Claims, 12 Drawing Figures

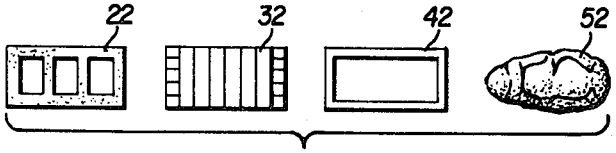

FIG. 3

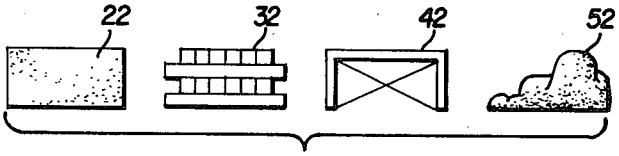

FIG. 4

FIG. 5

12

| | |
|---|---|
| ESTIMATED MATERIAL | $ 400,000 |
| ESTIMATED LABOR | 300,000 |
| TOTAL | $ 700,000 |
| COST TO BID | $ 6,500 |
| TYPE OF WORK | CONCRETE |

| | |
|---|---|
| ESTIMATED MATERIAL | $ 600,000 |
| ESTIMATED LABOR | 150,000 |
| TOTAL | $ 750,000 |
| COST TO BID | $ 8,000 |
| TYPE OF WORK | HIGHWAY |

| | |
|---|---|
| ESTIMATED MATERIAL | $ 100,000 |
| ESTIMATED LABOR | 300,000 |
| TOTAL | $ 400,000 |
| COST TO BID | $ 5,000 |
| TYPE OF WORK | STEEL |

| | |
|---|---|
| ESTIMATED MATERIAL | $ 110,000 |
| ESTIMATED LABOR | 140,000 |
| TOTAL | $ 250,000 |
| COST TO BID | $ 1,500 |
| TYPE OF WORK | TIMBER |

| | |
|---|---|
| ESTIMATED MATERIAL | $ 200,000 |
| ESTIMATED LABOR | 300,000 |
| TOTAL | $ 500,000 |
| COST TO BID | $ 5,000 |
| TYPE OF WORK | TIMBER |

| | |
|---|---|
| ESTIMATED MATERIAL | $ 300,000 |
| ESTIMATED LABOR | 200,000 |
| TOTAL | $ 500,000 |
| COST TO BID | $ 4,000 |
| TYPE OF WORK | CONCRETE |

23

INVESTIGATION

- ☐ CONCRETE
- ☐ TIMBER
- ☐ STEEL
- ☐ HIGHWAY

FIG. 12

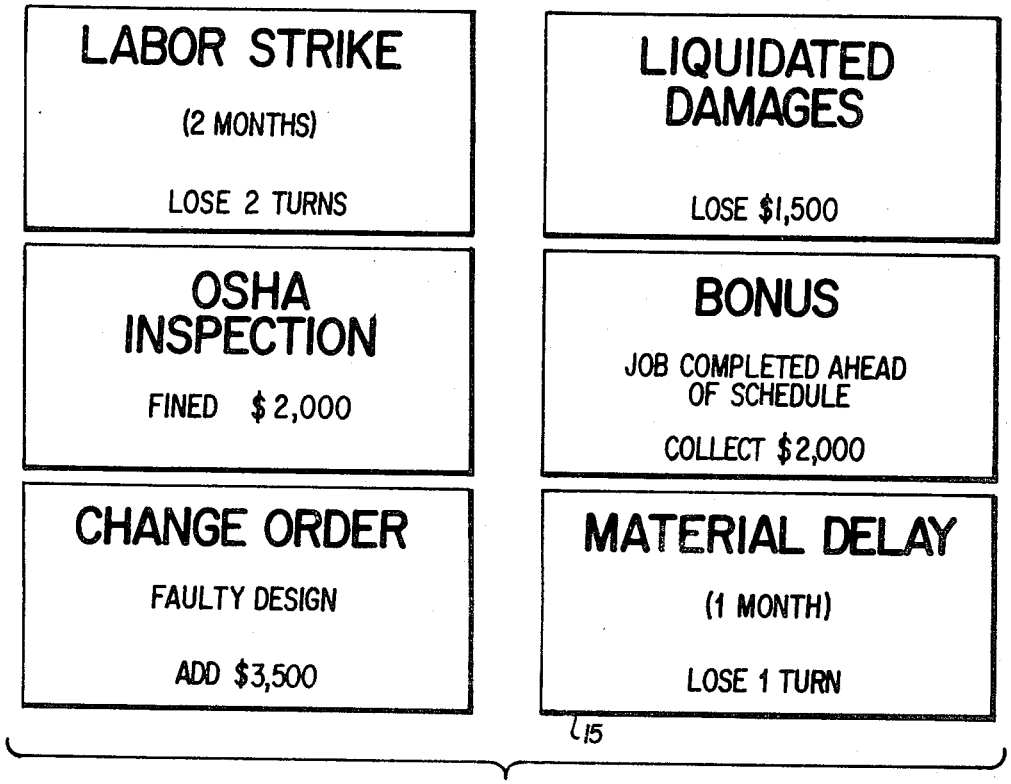
FIG. 8
FIG. 11
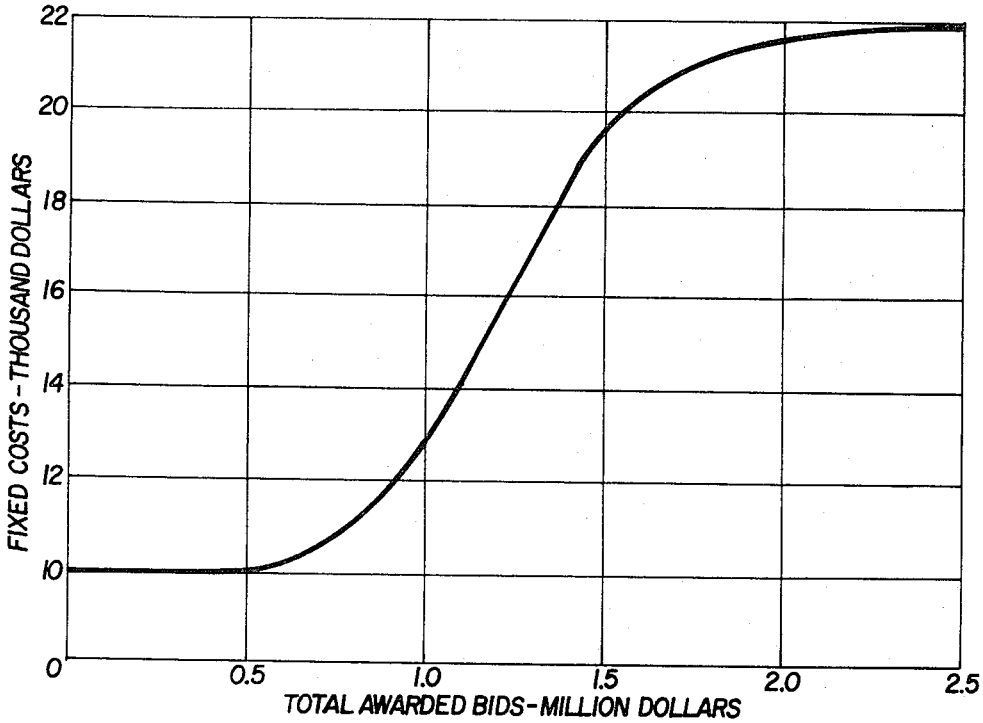

LOW BIDDER

BID SUBMITTAL FORM

YEAR _____
JOB # _____
JOB TYPE _____

_____ Construction Company

1. Direct Costs a. Labor
      (1) Estimated Labor (Fixed) #_____
      (2) Labor Factor _____
      (3) Adjusted Est. Labor (1a(1) x 1a(2) = $_____
   b. Estimated Materials (Fixed) $_____
   c. Subtotal $_____
   d. Research Bonus Factor _____
   e. Total Direct Cost (1c x 1d) $_____

2. Operating Costs a. Fixed Costs $_____
   b. Bidding Costs (Fixed) $_____
   c. Research Costs (if any) $_____
   d. Investigation Costs (if any) $_____
   e. Growth in Business Expense (5%) $_____
   f. Labor Factor Costs (if any) $_____
   g. Subtotal $_____
   h. Pro-rated Operating Expenses
      (1) Total Direct Costs - Current Year (Anticipated) $_____
      (2) Direct Costs this Bid (1e) $_____
      (3) Percent 2h(2) is of 2h(1) _____%
   h. Total Indirect Cost pro-rated (2h(3) x 2g) $_____

3. Total Cost (except capital costs) (1e + 2h) $_____

4. Profit $_____

5. Total Cost + Profit (3 + 4) $_____

6. Capital Charges 1/200 x (5) $_____

7. Bid Amount (5 + 6) $_____

FIG. 9

LOW BIDDER

ANNUAL ACCOUNTING FORM

_____ Construction Company YEAR_____

1. Start of Year
   a. Available Capital (from prior year) $_____
   b. Work Force Level (from prior year) $_____

2. Current Year
   a. Job receipts (total of Bids Awarded)(1b for next year) $_____
   b. Direct Costs

| JOB NO. | ESTIMATED LABOR | LABOR FACTOR | ACTUAL COSTS | | SUB-TOTAL | RESEARCH FACTOR | TOTAL |
|---|---|---|---|---|---|---|---|
| | | | LABOR | MATERIAL | | | |
| | | | | | | | |
| | | | | | | | |
| | | | | | | | |
| | | | | | | | |
| | | | | | | | |
| | | | | | | | |
| | | | | | | | |
| | | | | | | | |
| | | | | | | | $ |

c. Operating Expenses
      (1) Capital Charges (1/200 of item 2a) $_____
      (2) Fixed Costs (see chart) $_____
      (3) Bidding Costs $_____
      (4) Research Costs $_____
      (5) Penalties (+ or -) $_____
      (6) Investigation Costs $_____
      (7) Growth in Business (5% of item 2a - item 1b, N/A First Year) $_____
      (8) Labor Factor Costs $_____
      (9) Sub-total . . . . . $_____ d. Total Costs (Tem 2b + Item 2c(8) . . . . . $_____
   e. Gross Profit (Item 2a - Item 2d) . . . . . $_____
   f. Taxes (50% of Item 2e) . . . . . $_____
   g. Net Profit (Item 2f - Item 2e) . . . . . $_____

3. New Available Capital (Item 1a + Item 2g) . . . . . $_____

FIG. 10

CONSTRUCTION INDUSTRY TEACHING GAME

This invention relates to a construction industry teaching game and particularly concerns a teaching game involving bidding on construction jobs.

BACKGROUND OF THE INVENTION

This present invention has educational as well as entertainment features since players of the game will gain instruction on various construction practices such as bidding, financial accounting, OSHA regulations, specialty construction and the like.

The game is basically one of bidding strategy. Strategy, defined as "skillful management in getting the better of an adversary" is especially important to contractors. They receive or lose jobs because of their particular strategy in bidding, and similarly they make a profit or go broke directly because of this strategy.

Strategy in the game depends on many variables, as it does in the real world, and these must be taken into account in arriving at the final plans. Whenever jobs are bid too low, the player will not be able to cover operating expenses with the small margin allowed. Neither will other players, unable to obtain jobs, be able to cover their costs. Everyone, therefore, loses.

In competition bidding, any attempt to be low bidder on every single job is usually disastrous. The object is to bid low enough to get jobs with reasonable frequency, but high enough to cover operating costs and return a fair profit.

Anyone can bid low enough to get jobs, simply by bidding below cost. Similarly, a high bid may ensure a profit, but will seldom get a job. The strategic bid lies between these two extremes; finding it is management's major challenge in competitive bidding.

For further comprehension of the invention, and of the objects and advantages thereof, reference will be made to the following description and accompanying drawings.

BRIEF DESCRIPTION OF THE DRAWINGS

FIG. 3 is an elevation view of a plurality of playing pieces for the various players or teams, each piece representing a readily distinguishable object;

FIG. 4 is a plan view of the playing pieces of FIG. 3;

FIG. 5 is a representation of a set of cards identified as "Job" cards;

FIG. 8 is a representation of a set of cards identified as "Penalty and Situation" cards;

FIG. 9 is a representation of a form identified as "Bid Submittal Form";

FIG. 10 is a representation of a form identified as "Annual Accounting Form";

FIG. 11 is a graph used to determined "Fixed Costs" for the Annual Accounting Form of FIG. 10; and FIG. 12 is representative of cards identified as "Investigation Cards".

BRIEF DESCRIPTION OF THE INVENTION

Figure 1:
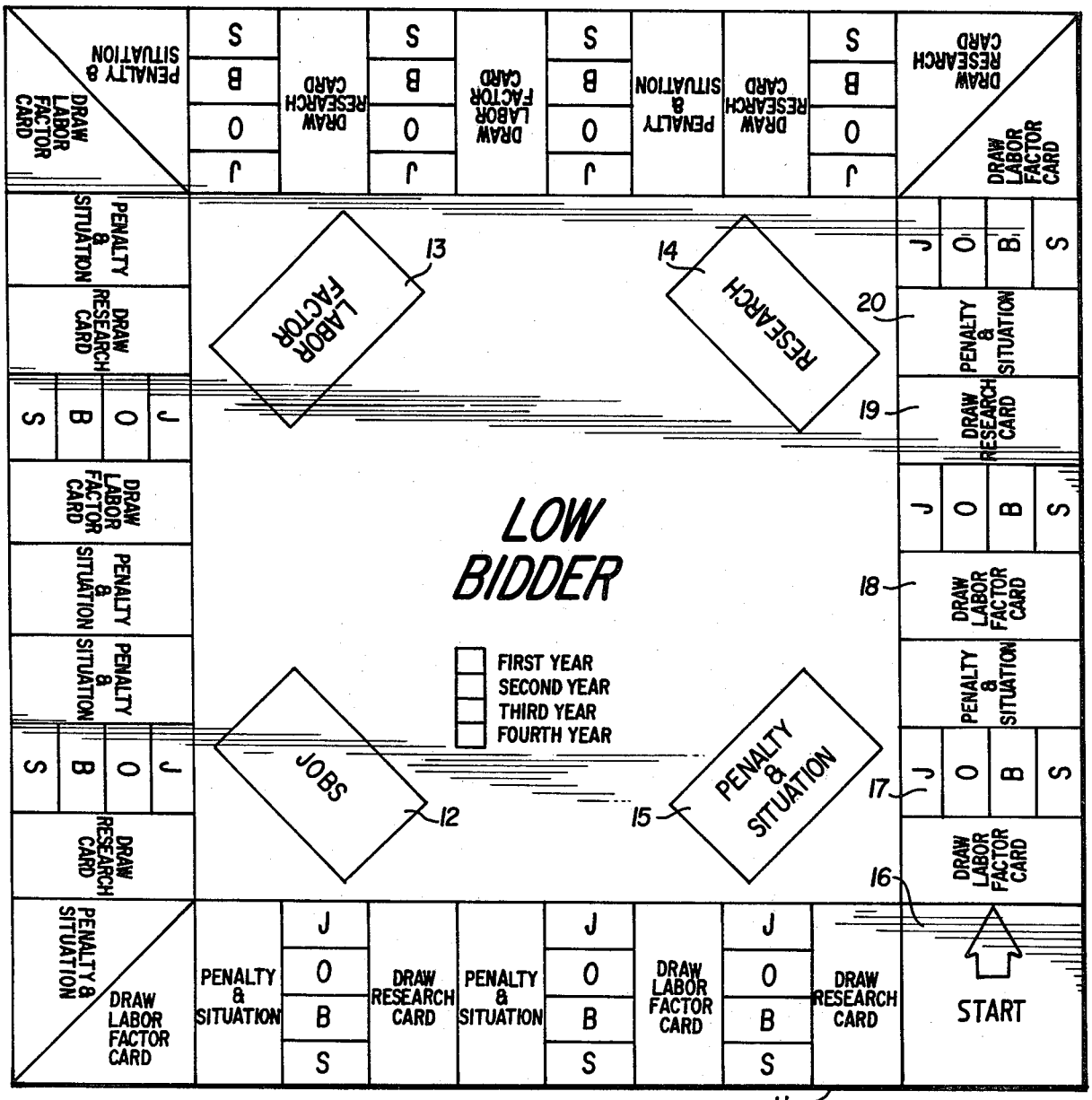
FIG. 1 is a plan view of the game board employed in playing the game.
Figure 2:
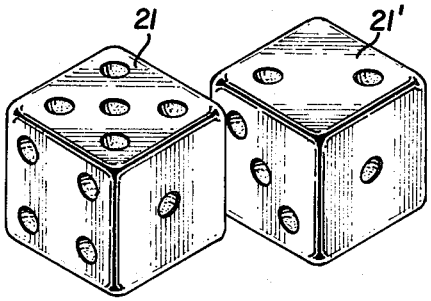
FIG. 2 is a perspective view of the dice employed in playing the game.

Referring first to FIG. 1, there is shown a square contract board 11 on which the game is designated LOW BIDDER. This board has its margins marked off into rectangular spaces or boxes designated as follows:

JOBS
DRAW LABOR FACTOR CARD
DRAW RESEARCH CARD
PENALTY & SITUATION

Figure 6:
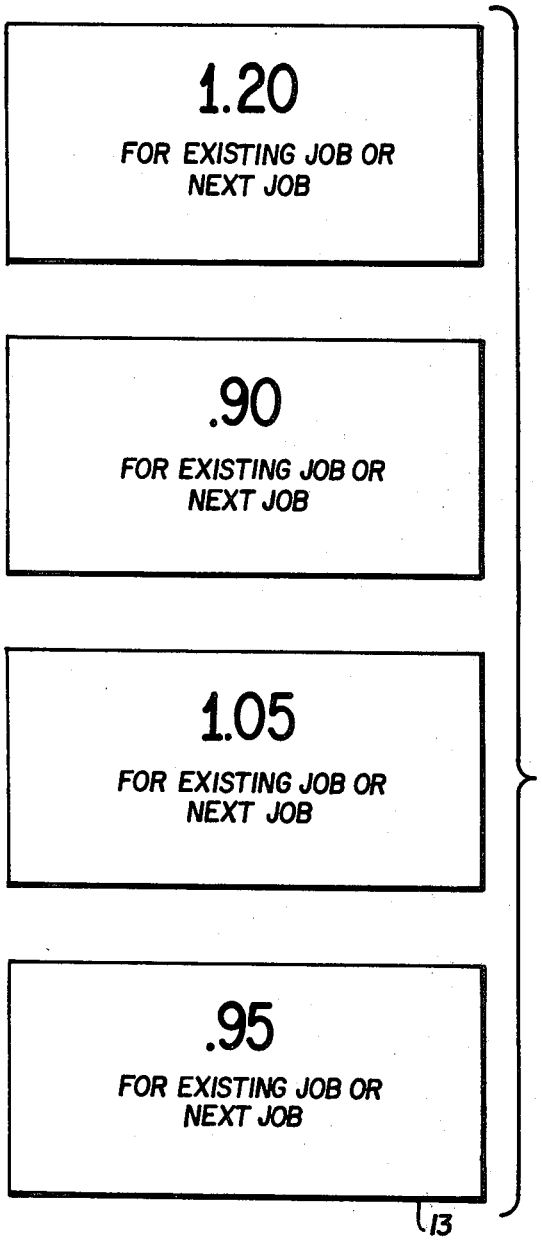
FIG. 6 is a representation of a set of cards identified as "Labor Factor" cards.
Figure 7:
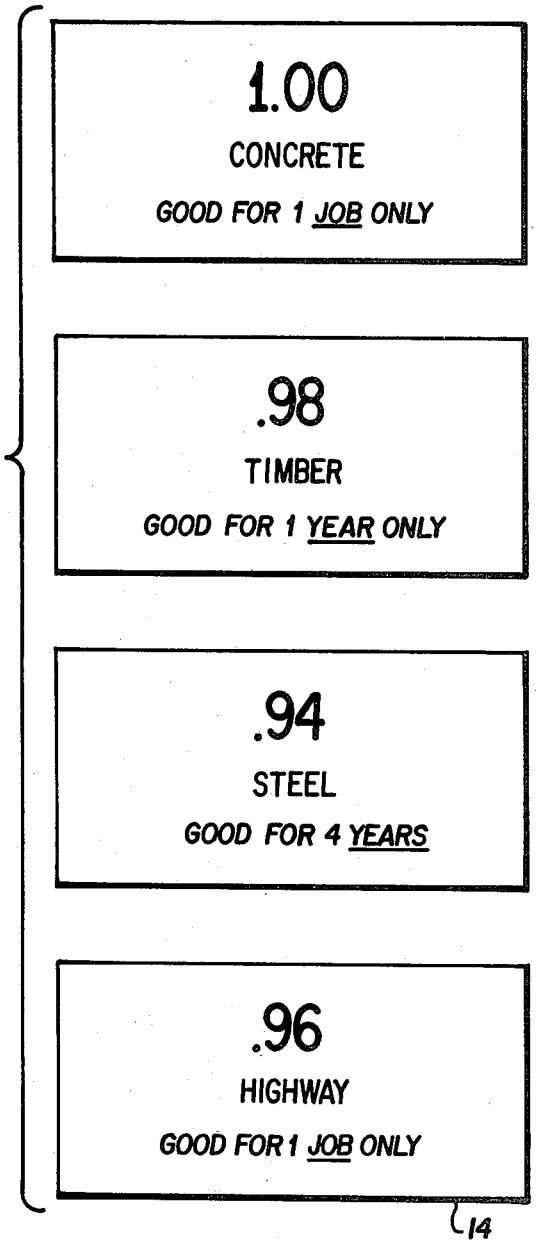
FIG. 7 is a representation of a set of cards identified as "Research" cards.

Inside the margin of the board 11 are four spaced rectangles 12, 13, 14 and 15 upon which are respectively placed decks of JOB CARDS 12 shown in FIG. 5, LABOR FACTOR CARDS 13 shown in FIG. 6, RESEARCH CARDS 14 shown in FIG. 7, and PENALTY & SITUATION CARDS 15 shown in FIG. 8.

A box 16 marked START on board 11 indicates the starting area. The play of the game proceeds in a counter-clockwise direction as indicated by the arrow. The game covers a four-year period, and the spaces 17 on the board marked JOBS are divided into four colors, each color representing one year. A year is one complete circuit around board 11.

In playing the game, each player or team tries to make a profit by submitting bids, low enough to be awarded jobs, but high enough to cover both the operating expenses and direct job costs, and also to yield a profit. At the end of the four years (4 times around the board 11), the player or team with the most money wins the game.

The game may be played with two, three, or four players or teams.

DETAILED DESCRIPTION OF THE INVENTION

Starting the Game

At the beginning of play, each player, which hereinafter may also refer to a team, is assigned a different playing piece (marker) 22, 32, 42, 52 for his use. In addition, each player is given four annual accounting forms as shown in FIG. 10, a pad of bid submittal forms as shown in FIG. 9, and five investigation cards 23 as shown in FIG. 12. The purpose of these forms is to put all procedural operations on a common level, thereby allowing variations to be maintained at the strategy level. These forms must be completed during the course of the play and submitted at the end of each year or each complete circuit around the board.

Each player starts with $200,000 in capital. The total dollar value of all bids received during any one year cannot exceed twenty times the available capital for the year. The available capital for years after the first year will be determined by performance in the preceding year as shown on the Annual Accounting Form of FIG. 10.

Each player throws the dice 21 in turn. The players then take turns in playing according to the number of dots uppermost on the thrown dice. The player throwing the highest number goes first, then those throwing lesser numbers follow in play.

The starting player throws the two dice 21 and 21' and moves his playing piece such as 22 a number of boxes from box 16 in a counter-clockwise direction equal to the number of dots appearing uppermost on the thrown dice. The playing piece may land on any of the boxes 17, 18, 19 or 20 which will permit him to select a job for bidding, draw a labor factor card, draw a research card, or penalty & situation card.

Playing the Game

When a player lands on one of the colored JOBS spaces 17, a job card 12 is drawn from the job card deck for that year (color) and all players get a chance to bid on that job. There are sixty-four job cards, ranging from $100,000 to $900,000, and averaging $400,000. The job cards are equally divided into four categories of work: Concrete, Steel, Timber, and Highway; and a player may specialize in one or more of these types of work. A player may choose not to bid on some jobs. Should this be the case and there is only one bidder, and he bids high, he could be the winner. Bids are secret until called for, at which time all bid forms as shown in FIG. 9 are submitted and the bid winner announced. The player who landed on that job space is responsible for collecting all bids and announcing the low bidder.

Bidding

To bid, a player must complete the Bid Submittal Form of FIG. 9. As indicated before, there are both operating expenses and direct job costs involved in any job. Operating costs consists of (a) fixed costs, (b) work force level costs, (c) bidding costs, (d) capital costs, (e) research costs, and (f) investigating costs.

Fixed costs are determined by the volume of business undertaken, with a minimum cost of $10,000/year. The graph as shown in FIG. 11 determines the fixed cost for any dollar volume of business for the year. The fixed cost will remain the same for any one year, once it has been determined. This cost is entered on line *2a* of the Bid Submittal Form of FIG. 9.

Work force level cost is determined by the dollar volume of gross receipts for the year. Any increase in work force level over the previous year, as determined by an increase in dollar volume of gross receipts of current year over previous year is assessed a five percent growth of business charge, which applies to that year only and which then becomes the new work force level for the following year. A decrease in work force level below the previous year is not charged. This figure is entered on Line *2e* of the Bid Submittal Form.

Bidding costs are the costs to bid a job. These are fixed costs and are indicated on Job Cards 12 and listed when the job is advertised. These costs are incurred if the job is bid, whether or not the award is received. These costs are entered on Line *2b* of the Bid Submittal Form.

Capital costs are charged for the use of the player's capital, and are equal to ten percent of the capital used, which is equal to one-twentieth (1/20) of the total bids received or awarded. Therefore, they are equal to one-two hundredth (1/200) of the total dollar value of total bids received or awarded. This cost is entered on Line 6 of the Bid Submittal Form and Line *2c* (1) of the Annual Accounting Form.

Direct job costs arise from the job itself, and consist of the labor and material costs of the job which are indicated on the Job Cards 12. These may be modified by the use of Labor Factor Cards 13 and/or Research Cards 14, described later. Direct costs are entered on Line 1 of the Bid Submittal Form and Line *2b* of the Annual Accounting Form.

Labor Factors

To simulate a contractor bidding a job in an area in which he is unfamiliar with labor wages and which may be higher or lower than his normal prevailing rates, Labor Factor Cards 13 are utilized. When a player lands on a Draw Labor Factor Card space 18, a Labor Factor Card 13 is drawn from the Labor Factor deck. Labor Factor Cards 13 range from 0.94 to 1.25, averaging 1.026. These factors are used to modify the estimated labor cost as indicated on the Job Cards 12 to obtain the actual direct labor cost. The labor factor is entered on Line 1*a*(2) of the Bid Submittal Form and on Line 2*b* of the Annual Accounting Form. Labor Factor Cards 13 can only be used once and are then placed back in the card pack. If a player has a Labor Factor Card at the time of a job bid, this factor must be used if the player decides to bid on that job. Should a player have a high Labor Factor Card 13 and lands on another Draw Labor Factor card space 18 prior to bidding on a job, he may elect to improve his factor by replacing the existing card at the bottom of the pack and drawing another card. Only one Labor Factor Card 13 will be held at any one time by any one player. If a player does not have a Labor Factor Card 13 at the time of bid, he may draw one for $1,000. This amount is entered on the Annual Accounting Form on line 2*c*(8) and on the Bid Submittal Form on line *2f*.

Research

To simulate a contractor specializing in a particular type of work, Research Cards 14 are utilized. When a player lands on a space marked Draw Research Card 19, a Research Card 14 is drawn from the top of the Research Card deck. This deck contains forty-eight cards, ranging from 0.94 to 1.00 with an average of 0.97 for the deck. Of these forty-eight cards, twelve are permanent (good for all four years), twelve are semi-permanent (good for 1 year only), sixteen are temporary (for one job only), and eight are no-advantage (1.00). The Research Cards 14 permit a player to specialize in one or more types of construction, i.e. steel, timber, concrete, highway. This factor is used to modify both the labor and material costs or total costs of a job. The factor is entered on line 1*d* of the Bid Submittal Form and on line *2b* of the Annual Accounting Form.

If a player does not have a Research Card 14 when a job is bid and desires one, he may draw one for $5,000 a draw, which, in turn, lessens the capital and also limits the bidding potential (20 times the available capital). This $5,000 would be entered on Line *2c* of the Bid Submittal Form and on Line 2*c*(4) of the annual Accounting Form.

Once a job is awarded, if a player decides to draw a Research Card 14, the cost is increased to $10,000 per draw and the cost entered on Line 2*c*(4) of the Annual Accounting Form.

Research Cards are good only for the type of construction work indicated thereon and apply to the total direct costs for the job (labor and material).

Permanent cards offer a continuing advantage to the bidder, but only if kept secret, for permanent cards may be investigated by any player. This may be done by use of Investigation Cards 23 as shown in FIG. 12 at any time of the year but only once per player for any one year. Each investigation costs $2,500 and is entered on Line 2*c*(6) of the Annual Accounting Form. An investigation must be for a specific type of construction work. Should an investigation disclose a fraud, that player loses all his jobs for that year in that construction category.

Penalties and Situations

When a player lands on a space marked Penalty and Situation 20, he must draw a Penalty and Situation Card 15 from the Penalties and Situation deck 15 and comply with the instructions thereon. Total penalties, dollarwise, are entered on Line 2c(5) of Annual Accounting Form as a plus or minus.

All jobs for any one year are considered complete at the time a player passes the START space 16 and begins another year.

The game will impart to players a general knowledge of the construction industry and will also be entertaining to participants and observers.

While the above description and drawings illustrate the preferred embodiments of my invention, it is to be understood that the invention is not limited to the precise construction herein disclosed and that various changes and modifications may be made within the scope of the invention as defined in the appended claims. This game or invention may also be played by means of a computer with numerous and various inputs for the various jobs and factors.

I claim:

1. A construction board teaching game apparatus wherein players strive to maximize their financial worth comprising a plurality of playing pieces, each piece representing one player during use of said board game apparatus;

a game board having a playing surface and a track on said game board having a series of spaces forming a continuous path along which a game piece is movable in increments determined by chance means, said path having a plurality of spaces having indices relating to the action to be taken when said playing piece alights on one of said spaces;

a pair of dice, each one of said pair of dice having indicia means for indicating numbers to dictate movement of the playing pieces over the path of said game board from the starting space;

a plurality of job cards, each card representing a specific type of construction and indicating thereon estimated material and labor costs, total costs, cost of bidding job and type of construction;

a plurality of labor factor cards with differing predetermined mathematical factors, such factor to be used in multiplying the labor cost for any job;

a plurality of research cards with differing predetermined mathematical factors, such factors to be used in multiplying the total job cost for a specific type of construction work;

a plurality of penalty and situation cards indicating various penalties and situations involving the construction industry;

a bid submittal form to be completed by each player whenever said player bids on any job;

an annual accounting form to be completed by each player for each year (one turn around board) of the game; said bid submittal form and said annual accounting form including entry lines correlated with said labor factor cards, said research cards and at least one of said costs indicated on said job cards;

a graph to be utilized for determining fixed costs based on total dollar volume of business for said year; and a plurality of investigation cards given to each player to permit investigation of research cards.

2. The board game of claim 1 wherein said labor factor cards range from 0.94 to 1.25.

3. The board game of claim 1 wherein said research card factors range from 0.94 to 1.00.

4. The board game of claim 1 wherein said research cards comprise a predetermined number of cards which are designated as permanent for the period of said game;

a predetermined number of cards which are designated as a specified increment of said game;

a predetermined number of cards which are designated as good for one job only; and a predetermined number of cards which are designated as a factor of one.

* * * * *